US005813573A

United States Patent [19]

Battegazzore

[11] Patent Number: 5,813,573

[45] Date of Patent: Sep. 29, 1998

[54] DISPENSER FOR THE SIMULTANEOUS DELIVERY OF AT LEAST TWO PASTE-LIKE PRODUCTS

[75] Inventor: Piero Battegazzore, Alessandria, Italy

[73] Assignee: Guala S.p.A., Alessahdria, Italy

[21] Appl. No.: 661,971

[22] Filed: Jun. 12, 1996

[30] Foreign Application Priority Data

Jun. 28, 1995 [EP] European Pat. Off. ..... 95830269

[51] Int. Cl.[6] ..... B67D 5/72

[52] U.S. Cl. ..... 222/135; 222/207; 222/556

[58] Field of Search ..... 222/136, 135, 222/207, 556, 212, 380

[56] References Cited

U.S. PATENT DOCUMENTS

| | | | |
|---|---|---|---|
| 3,726,442 | 4/1973 | Davidson et al. | 222/207 |
| 4,155,487 | 5/1979 | Blake | 222/207 |

FOREIGN PATENT DOCUMENTS

| | | |
|---|---|---|
| 0289244 | 11/1988 | European Pat. Off. . |
| 0304567 | 3/1989 | European Pat. Off. . |
| 0368062 | 5/1990 | European Pat. Off. . |
| 0376097 | 7/1990 | European Pat. Off. . |
| 0447335 | 9/1991 | European Pat. Off. . |
| 0452260 | 10/1991 | European Pat. Off. . |
| 0520315 | 12/1992 | European Pat. Off. . |
| 0565977 | 10/1993 | European Pat. Off. . |
| 2659631 | 9/1991 | France . |
| 1475180 | 3/1969 | Germany . |
| 8518670 | 8/1985 | Germany . |
| 3716109 | 12/1988 | Germany . |
| 9302196 | 6/1994 | Germany . |

*Primary Examiner*—Gregory L. Huson
*Attorney, Agent, or Firm*—Kalow, Springut & Bressler; David A. Kalow; Milton Springut

[57] ABSTRACT

A dispenser for the simultaneous delivery of at least two paste-like products, comprising a container with a head and internally formed with two separate cylindrical chambers which lie side by side parallel to their longitudinal axes, each chamber being open towards the head and having an associated end wall which sealingly slides in a single direction towards the head. A resilient pump member under the head includes a tubular sleeve and is formed from a resiliently flexible cup-shape membrane for each cylindrical chamber of the container with the concave part facing towards these latter. An operating lever for pressing and releasing the pump member is pivoted about an axis which is fixed with respect to the container disposed perpendicular to the longitudinal axis of the said cylindrical chambers and which is turnable about the said axis from a rest position to a paste delivery position and vice versa. A delivery duct which contains two channels which are separated by a dividing partition is attached to the sleeve. It has an outlet, positioned on the head which leads to the exterior thereof.

The dispenser also includes a transverse cover element for connecting the open ends of the side-by-side chambers of the container, the said element having a respective aperture which corresponds to each cylindrical chamber.

4 Claims, 4 Drawing Sheets

DISPENSER FOR THE SIMULTANEOUS DELIVERY OF AT LEAST TWO PASTE-LIKE PRODUCTS

The present invention concerns a dispenser for the simultaneous delivery of at least two paste-like products so as to constitute when mixed together, for example, a toothpaste.

Since such products chemically react with each other when mixed, it is necessary that they are stored apart in the dispenser and also that they are delivered separately such that they combine only at the end of the delivery outlet of the dispenser and therefore only at the moment of use.

Dispensers suitable to fulfil the functions indicated above are known in the relevant prior art and various examples are described and illustrated in EP-A-O 520 315 and EP-A-O 388 185.

In both of the examples illustrated in the aforesaid documents, the dispensers comprise two separate cylindrical chambers, positioned side by side parallel to their longitudinal axes, each being able to store a product for delivery which mixes with the other product only downstream of the delivery outlet.

In the case of the structure shown in EP-A-O 520 315, each product storage chamber is associated with a related metering pump having inlet and outlet valves. Each pump, has a bellows as the pumping mechanism and the bellows of both pumps are operated manually by compressing a common actuator which creates pump strokes of different lengths so as to obtain metered quantities of product in a predetermined ratio.

In the case of the structure shown in EP-A-O 388 185 the storage chambers are associated with related rigid pistons which pass through their ends. By creating axial compression on the upper end of the dispenser manually the products are simultaneously pumped from the respective chambers through separate channels to a delivery outlet at the end of which they are mixed and used.

The known dispensers mentioned in the above documents, although achieving the aim of separately storing and delivering two products which are to be mixed only at the end of the delivery tube, have respective serious disadvantages.

In the case of the embodiment shown in EP-A-O 520 315 the presence of a completely separate metering pump for each storage chamber and actuation means which apply different length strokes to the pump bellows, gives rise to complications of a constructional nature which, besides making the devices expensive, adversely affect their functioning over time thus penalising use of a refillable version of the dispenser which uses replacement containers.

In the case of the structure shown in EP-A-O 388 185, the overall cylinder-piston configuration makes the dispenser very cumbersome and somewhat unstable when stood on end particularly when the storage chambers are completely filled with product.

The problem upon which the present invention is based is that of making a dispenser of the aforementioned type which is structurally simple, reliable in normal use for a sufficiently long time by enabling its operation with refills, and which is economically advantageous.

The problem is resolved by a dispenser for the simultaneous delivery of at least two paste-like products, comprising a container having a head and being formed internally from two separate cylindrical chambers which are side by side parallel to their longitudinal axes, each chamber being open towards the head and having an associated end wall sealingly slidable within it towards the head, a resilient pumping member positioned under the head, a tubular sleeve with a free end the opposite end being fixed to the pumping member, an operating lever for pressing and releasing the pumping member, the said lever being pivoted about an axis which is fixed with respect to the container positioned perpendicular to the longitudinal axis of the said cylindrical chamber and turnable about the said axis from a resting position to a paste delivery position and vice versa, a delivery duct containing two channels separated by a dividing partition having an inlet attached to the said free end of the sleeve and an outlet positioned at the head leading to the exterior thereof, the said operating lever having means for engagement with the said pumping member, characterised as in claim 1.

The invention will now be described more fully with reference to a preferred embodiment illustrated by way of example in the accompanying drawings in which.

Figure 1:
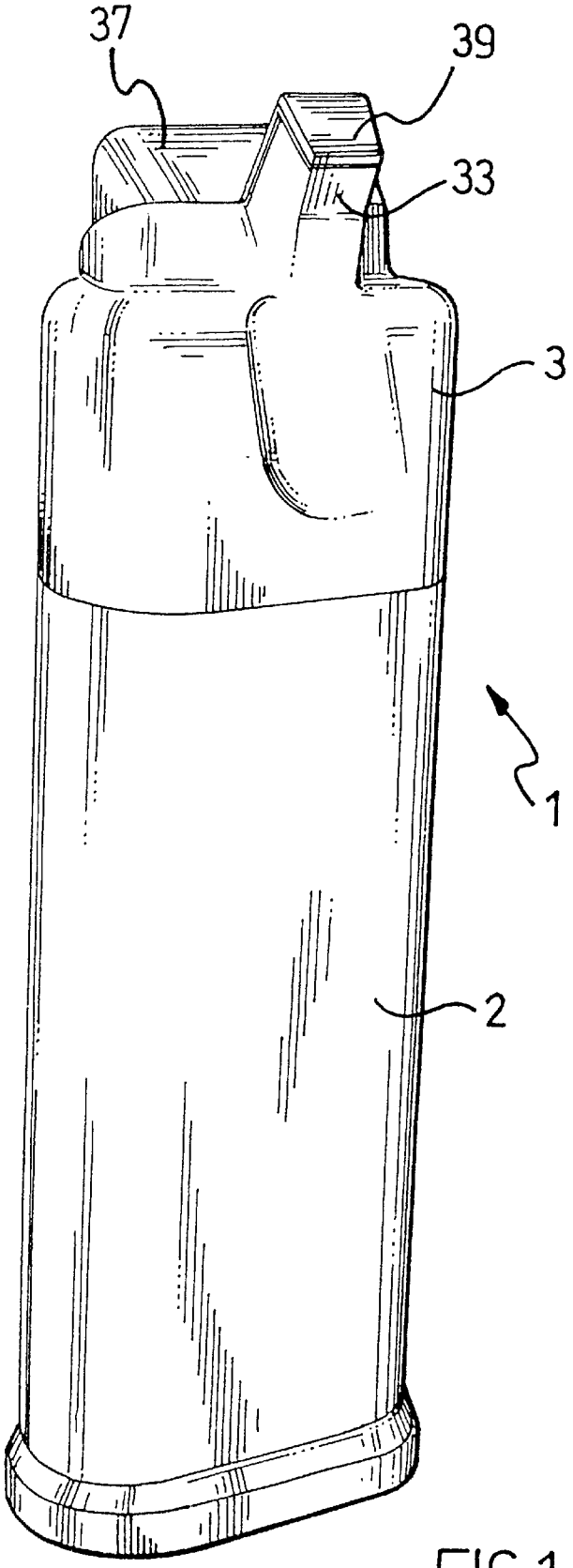
FIG. 1 is a perspective view of the dispenser according to the invention.
Figure 2:
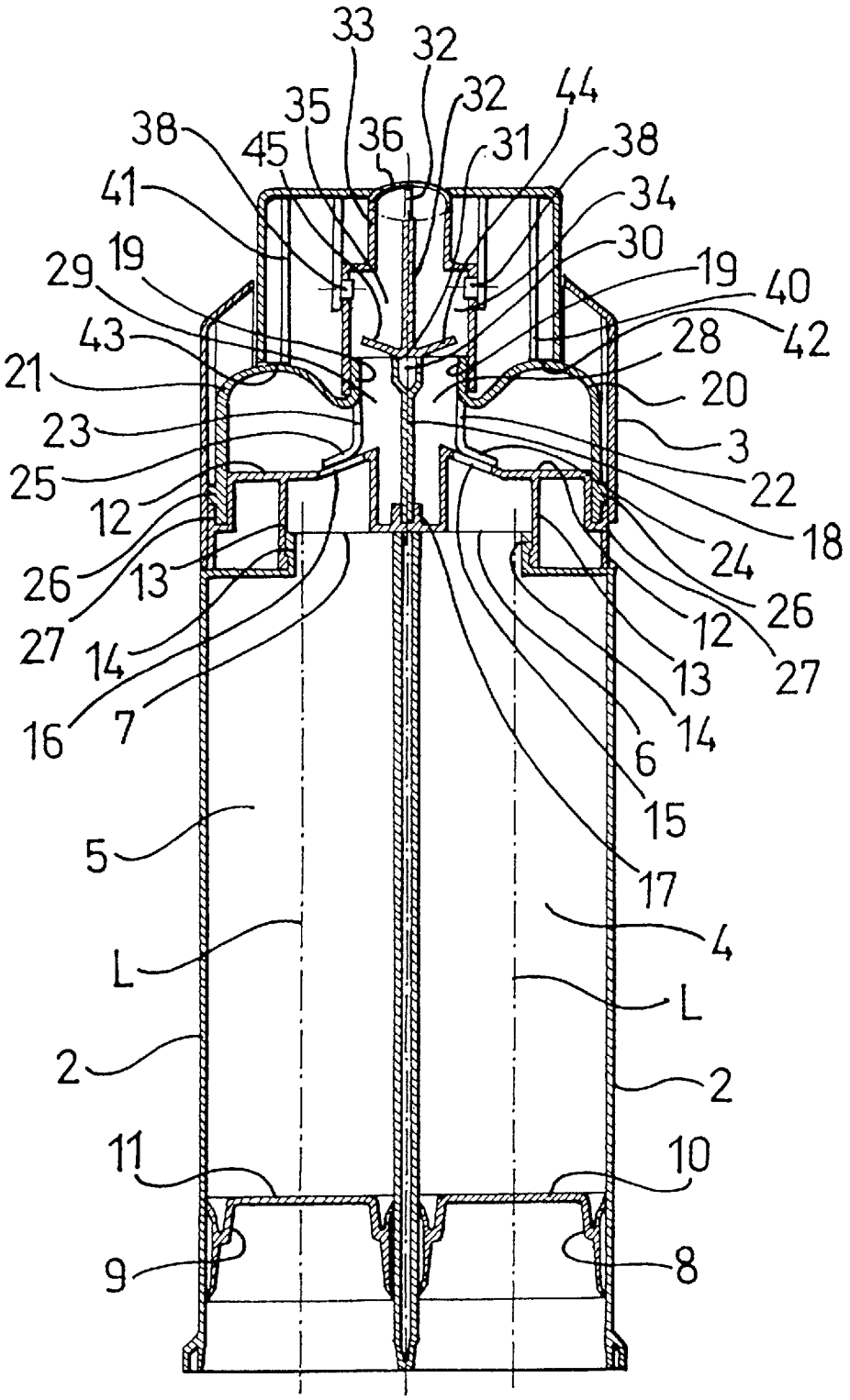
FIG. 2 is a transverse vertical section of the dispenser of FIG. 1.
Figure 4:
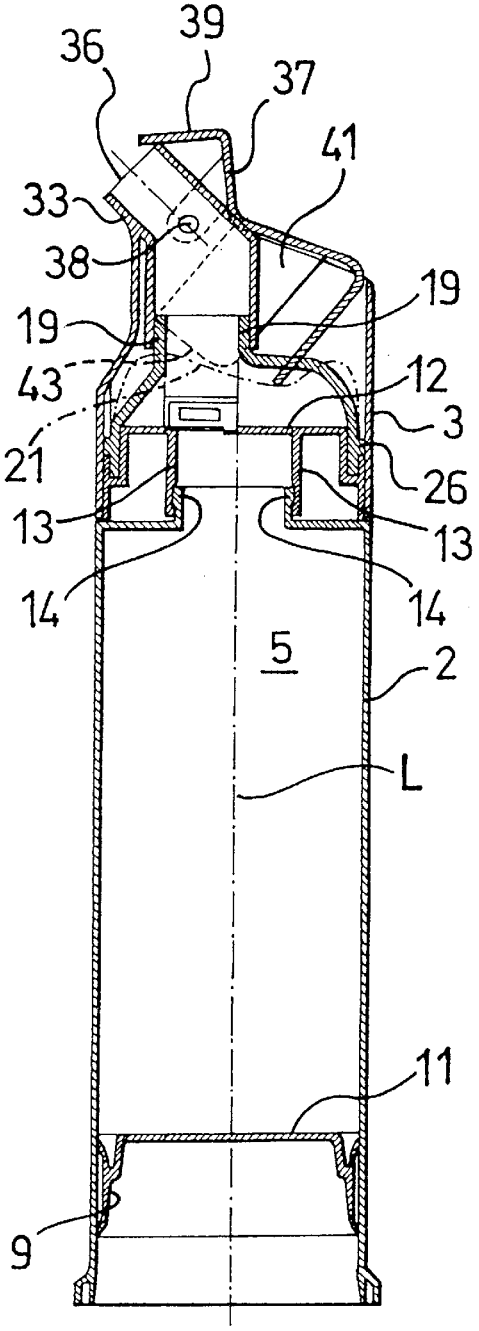
FIG. 4 is a transverse vertical section like FIG. 3 with the pumping unit in the operative position.
Figure 3:
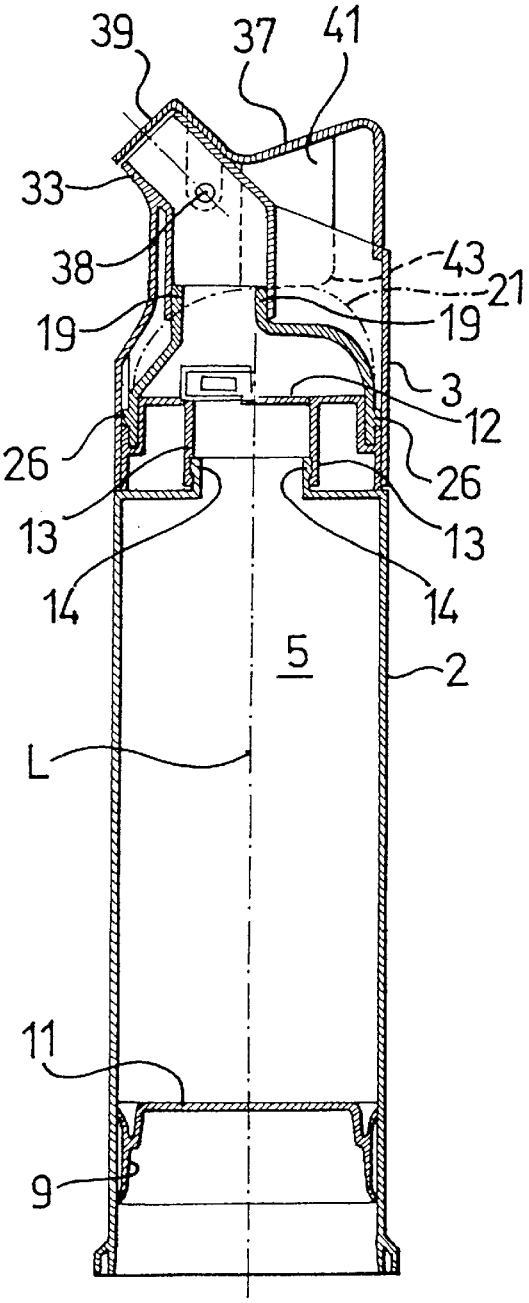
FIG. 3 is a transverse vertical section of the dispenser of the preceding figures with the pumping unit in the resting position.
Figure 5:
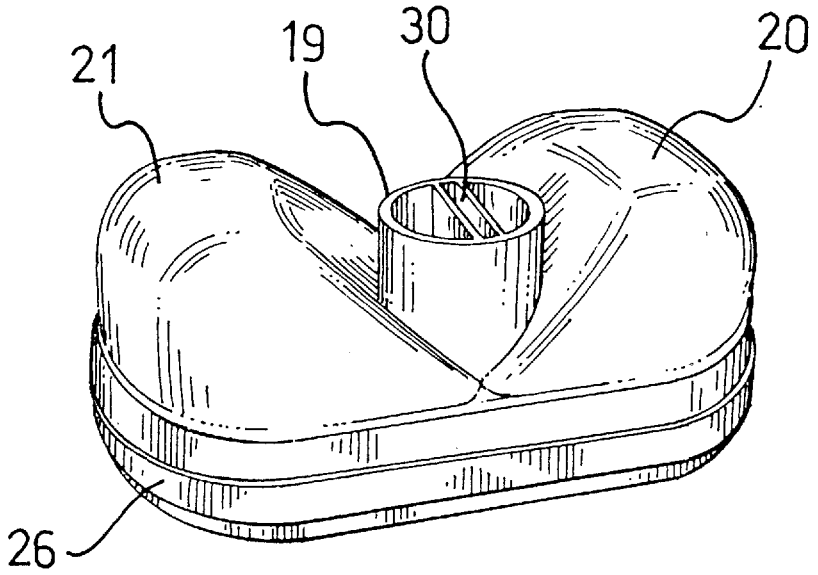
FIG. 5 is an external perspective view of the pumping unit.
Figure 6:
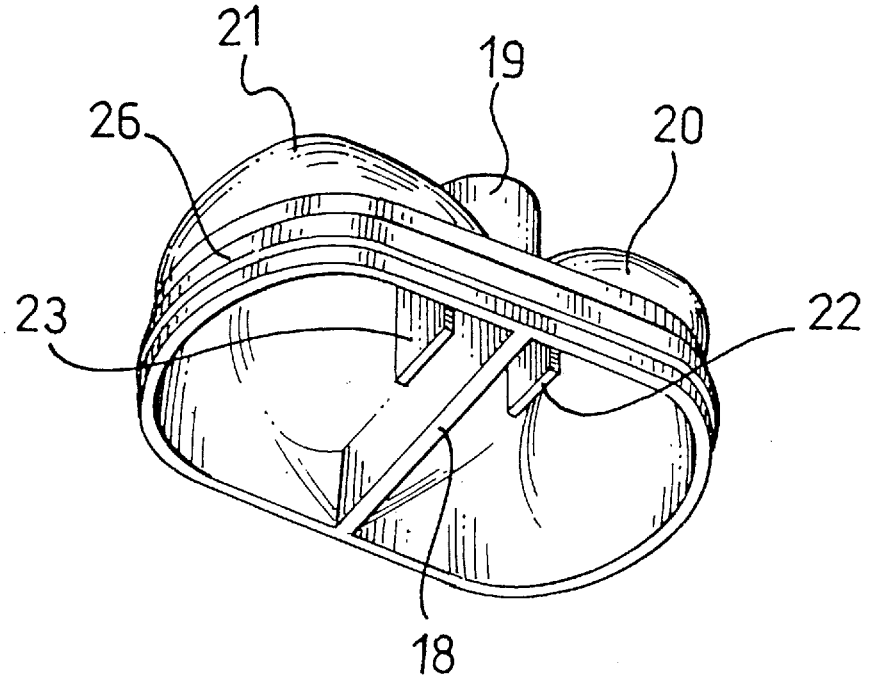
FIG. 6 is a perspective view of the inside of the pumping unit of the preceding figure.

With reference to the aforesaid Figures, the numeral 1 indicates the dispenser as a whole, which comprises a container 2 and a head 3.

The container 2 has two separate cylindrical chambers 4 and 5 which lie side by side parallel to their longitudinal axes L.

The chambers 4, 5 have respective openings 6, 7 towards the head 3 and have inside, as is conventional, pistons 8, 9 which constitute the end walls, 10, 11, which sealingly slide within respective chambers in the direction of the head 3.

The cylindrical chambers 4, 5 are intended to store respective paste-like products which must be conserved without coming into contact with one another until the moment of their delivery and only then when they are outside the dispenser 1.

Above the container 2 is a transverse cover element 12 which is snap-engaged by means of the collar 13 over the edge 14 of the container 2 surrounding the openings 6, 7 of the chambers 4, 5.

The cover element 12 has apertures 15, 16 which are aligned with the apertures 6, 7 of the storage chambers 4, 5.

The same cover 12 also has attachment means 17 which is axially aligned with the dividing partition 18 of the tubular sleeve 19, fixed to the pumping mechanism.

This latter is constituted by dome-shape membranes 20, 21, which axially overlie the chambers 4, 5, and apertures 15, 16 of the transverse element 12.

Resiliently flexible flat flaps 22, 23 of limited transverse extent are attached to the membranes 20, 21, parallel to the dividing partition 18.

The extremities 24, 25 of these flaps, which are bent at an angle, rest against the element 12 above the apertures 15, 16 so as to close them unidirectionally thereby constituting the first unidirectional valves which are necessary for the delivery of the products stored within the chambers 4, 5 and for the prevention of reverse flow.

The outer edge of the pumping member 26 with the membranes 20, 21 is inserted in the annular groove 27 which extends around the perimeter of the element 12. In this way the pumping member is firmly attached to the element onto which the head 3 is also attached.

The dividing partition 18 defines therefore two separate ducts 28, 29 which communicate with the respective storage chambers 4, 5 by means of the apertures 15, 16 and the associated valves 24, 25.

The same dividing partition 18 has an axial cavity 30 into which is fitted the end 31 of the dividing partition 32 of the delivery duct 33. This latter is therefore sub-divided into two channels 34, 35 which constitute an extension of the channels 28, 29 of the sleeve 19.

The delivery duct 33 leads to the outside of the head 3 with the outlet 36 also being divided by the partition 32.

An operating lever 37 which is rotatable about the pivot pins 38 is mounted on the head 3 and is positioned with its axis of rotation perpendicular to the axis L of the chambers 4, 5.

The lever 37 includes a cap 39 for covering the delivery outlet 36 when the lever is in the resting position.

Finally the same lever 37 has a pair of ribs 40, 41 the free ends 42, 43 of which are engaged upon sliding with the convex part of the flexible membranes 20, 21 of the pump so as to operate this latter which is thus pressed and released by pressing and releasing the lever 37.

Further unidirectional valves represented by the flexible flaps 44, 45 are provided in association with the attachment of the free edge of the tubular sleeve 19 and the inlet of the delivery channel 33.

Such flaps 44, 45 open the respective channels 28, 29 of the tubular sleeve 19 so as to enable the products to pass towards the respective channels 34, 35 of the delivery duct when the pumping action, performed by the lever 37 on the domed membranes 20, 21, pushes the products, which were previously sucked into the concave part of the same membranes, into the respective channels 28, 29 of the tubular sleeve, with contemporaneous closure of the apertures 15, 16 by means of the resiliently flexible edges 24, 25 of the flaps 22, 23.

From the above description it is apparent that the products stored in the chambers 4, 5 are kept completely separate until they reach the end of the delivery outlet 36 in a simple and therefore economically advantageous dispenser structure.

Furthermore the limited number of component parts and their simple construction enables the dispenser to function reliably for a long time, and numerous successive refills of the product are therefore possible by replacing the container 2.

It is claimed:

1. A dispenser for the simultaneous delivery of at least two paste-like products, comprising:

a container having a head and being formed internally from two separate cylindrical chambers which are side by side parallel to their longitudinal axes, each chamber being open towards the head and having an associated end wall sealingly slidable within it towards the head, a resilient pumping member positioned under the head, a tubular sleeve with a free end the opposite end being fixed to the pumping member, an operating lever for pressing and releasing the pumping member, the said lever being pivoted about an axis which is fixed with respect to the container positioned perpendicular to the longitudinal axis of the said cylindrical chambers and turnable about the said axis from a resting position to a paste delivery position and vice versa, a delivery duct containing two channels separated by a dividing partition having an inlet attached to the said free end of the sleeve and an outlet positioned at the head leading to the exterior thereof, the said operating lever having means for engagement with the said pumping member, at least one transverse cover element for attaching the open end of the said adjacent chambers of the container, the said element having a respective aperture corresponding to each cylindrical chamber and attachment means aligned with the dividing partition of the said delivery duct, a resiliently flexible dome-shape membrane in said pumping member for each of the cylindrical chambers of the container with the concave part facing towards them, a diametric dividing partition in said tubular sleeve axially connected on one side to the dividing partition of the said delivery duct and, on the other side, to the said attachment means of the said transverse element, thereby subdividing the sleeve into two separate ducts which lie side by side in alignment with those of the delivery duct, a pair of flexible flaps which are bent at their free ends over a respective underlying aperture of the transverse element, constituting first unidirectional valves, further unidirectional valve members being provided at the inlet of the delivery duct for each of its channels.

2. A dispenser according to claim 1, wherein the said lever has a covering cap which is integrally formed with the said operating lever and extends so as to cover the said outlet when the lever is in the rest position.

3. A dispenser according to claim 1 wherein the said transverse element has a perimetral groove for receiving and housing the outer edge of the pumping member.

4. A dispenser according to claim 1 wherein the said transverse element has a collar for snap engagement with the edge of the container.

* * * * *